US006634463B2

(12) United States Patent
Spannhake et al.

(10) Patent No.: US 6,634,463 B2
(45) Date of Patent: Oct. 21, 2003

(54) SWITCH OVER FROM THE MAINS SUPPLY TO A FREQUENCY CONVERTER BY A PHASE CORRECTION PROCESS FOR AN ESCALATOR DRIVE

(75) Inventors: Stefan Spannhake, Berlin (DE); Michael Mann, Berlin (DE); Gunter Blechschmidt, Berlin (DE); Peter Walden, Berlin (DE); Robert Oesterle, Berlin (DE); Michael B. Kocur, Berlin (DE)

(73) Assignee: Otiscelecator Company, Farmington, CT (US)

( * ) Notice: Subject to any disclaimer, the term of this patent is extended or adjusted under 35 U.S.C. 154(b) by 0 days.

(21) Appl. No.: 10/147,700

(22) Filed: May 16, 2002

(65) Prior Publication Data

US 2002/0189905 A1 Dec. 19, 2002

(30) Foreign Application Priority Data

Jun. 15, 2001 (DE) ..... 101 28 839

(51) Int. Cl.[7] ..... B66B 1/28
(52) U.S. Cl. ..... 187/293; 198/330; 198/572
(58) Field of Search ..... 187/293, 296, 187/247; 198/322, 330, 571, 572; 318/807–811, 800–803, 437, 110

(56) References Cited

U.S. PATENT DOCUMENTS 4,631,467 A * 12/1986 Herrmann et al. ..... 318/798
4,748,394 A 5/1988 Watanabe
4,916,368 A * 4/1990 Onoda et al. ..... 318/723
5,099,977 A * 3/1992 Hirose et al. ..... 198/323
5,785,165 A * 7/1998 Stahlhut et al. ..... 198/322
6,013,999 A * 1/2000 Howard et al. ..... 318/685
6,049,189 A 4/2000 Markus et al.
6,351,096 B1 * 2/2002 Jang ..... 318/811
2002/0162726 A1 * 11/2002 Henkel et al. ..... 198/330
2003/0000798 A1 * 1/2003 Williams et al. ..... 198/321
2003/0000801 A1 * 1/2003 Spannhake et al. ..... 198/322

FOREIGN PATENT DOCUMENTS

| | | |
|---|---|---|
| DE | 35 23 626 | 1/1986 |
| DE | 38 09 199 | 10/1988 |
| DE | 196 04 207 | 8/1997 |
| DE | 199 60 491 | 7/2001 |

OTHER PUBLICATIONS

Halbleiter–Schaltungstechnik, U. Tietze Ch. Schenk (1978).

* cited by examiner

*Primary Examiner*—Jonathan Salata

(57) ABSTRACT

Method for controlling the drive of a conveyor device (10), especially in the form of an escalator or moving sidewalk, switchable between load operation and no-load operation, having a drive motor (26) and a frequency changer (42) controllable at least with respect to frequency and phase position of its output voltage, in which the drive motor (26) in load operation is fed with a line voltage with essentially constant line frequency and in no-load operation with the frequency changer output voltage, the phase difference between the phase position of the line voltage and the phase position of the frequency changer output voltage is determined, the phase position of the frequency changer output voltage is corrected according to the determined phase difference and therefore essentially brought into agreement with the phase position of the line voltage and switching is produced as soon as this agreement is reached.

19 Claims, 3 Drawing Sheets

(1) MEASURMENT OF THE PHASE DIFFERENCE BETWEEN LINE VOLTAGE AND FREQUENCY CHANGER OF OUTPUT VOLTAGE.
(2) MEASURMENT OF MOTOR TERMINAL VOLTAGE.

SWITCH OVER FROM THE MAINS SUPPLY TO A FREQUENCY CONVERTER BY A PHASE CORRECTION PROCESS FOR AN ESCALATOR DRIVE

FIELD OF INVENTION

The invention concerns a method and device to control the drive of a conveyor device in the form of an escalator or moving sidewalk, switchable between load operation and no-load operation. The conveyor device comprises a line voltage connection that delivers an essentially constant line frequency, an electric drive motor, especially in the form of an induction motor or synchronous motor, and a frequency changer.

BACKGROUND OF THE INVENTION

A typical conveyor device for personal conveyance in the form of an escalator or moving sidewalk includes a number of closely adjacent steps that are moved by means of a drive motor in the form of an endless belt in the desired direction of conveyance.

To reduce the power consumption and wear of such conveyor devices, a switch has been made to place such conveyor devices in transport movement only when needed, otherwise bringing them to a stop. For this purpose, a transport requirement signal device is provided, for example in the form of a foot mat, light barrier or manually operated switch arranged in front of the conveyor device in the direction of conveyance by means of which the presence of a requirement for transport can be established. If the transport requirement is present, for example, because a person has walked on the foot mat, the conveyor device is placed in forward movement for a predetermined time and switched off again when no further transport requirement has been established within a predetermined time.

To avoid peak loads during frequent engagement and disengagement of the conveyor device, it is known from WO 98/18711 not to switch the drive motor on and off abruptly but to have the speed of the drive motor rise or fall ramp-like during the switching processes. Induction motors are mostly used for such conveyor devices. Since the speed of an induction motor depends on the frequency of the ac power mains, which means constant speed of the induction motor when directly fed from an ac system with constant line frequency, a controllable frequency changer is used with which the line frequency fed to it can be controllably converted to an output frequency different from the line frequency.

The cost for a frequency changer that supplies the drive motor of an escalator or moving sidewalk indeed during load operation would be high, since the costs of the frequency changer rise enormously with the output power that the frequency changer must be able to deliver.

In order to keep the acquisition and operating costs low, WO 98/18711 proposes that the conveyor device only be driven with full transport speed in load operation, and only with reduced no-load speed in standby operation or no-load operation, during which no transport requirement exists, and that the drive motor only be fed from the frequency changer during no-load operation and switching processes, but directly from the line voltage source during load operation. This creates the possibility of laying out the frequency changer much smaller in terms of maximum power, which leads to a significant cost saving relative to a frequency changer whose maximum power is adapted to load operation of the conveyor belt. The conveyor device known from WO 98/18711 then converts to no-load operation, if no additional transport requirement is reported after executing a transport order, and is only shut down when no additional transport requirement is reported for a predetermined time after switching into no-load operation.

With the mentioned measures, a significant reduction of load peaks and abrupt speed changes of conveyor devices is achieved. However, unduly high transient currents can still occur during changing between line feed and frequency changer feed of the drive motor, because of deviations between the line frequency and the output frequency of the frequency changer and their phase positions at the time of switching between line feed and frequency changer feed of the drive motor and because of the actual voltage of the drive motor, which can lead to overloading of the frequency changer and to jerky movement changes of the conveyor device.

Such phenomena are overcome with a method disclosed in the republished previous German Patent Application 199 60 491.6 of the applicant and in which the line voltage and the frequency changer output voltage are compared to each other with respect to frequency and phase position and the frequency changer is controlled at an output frequency that has a predetermined frequency spacing from the line frequency. If a requirement for switching of the conveyor device from load operation to no-load operation or vice-versa is reported by means of a transport signal device, a switching control signal that triggers switching of the drive motor between frequency changer feed and line feed is generated at the time after signaling of this operational switching requirement, at which the output frequency of the frequency changer has both the predetermined frequency spacing relative to the line frequency and also a predetermined phase spacing between the frequency changer output frequency and the line frequency. By not issuing the switching control signal at the time at which the output frequency of the frequency changer agrees with the line frequency both in terms of frequency and phase, but in advance of the time at which the output frequency of the frequency changer has the predetermined frequency spacing relative to the line frequency and has also reached the predetermined phase spacing between the frequency changer output frequency and the line frequency, it is allowed that the switching devices used for switching between no-load operation and load operation, usually contactors, do not operate free of delay, on the one hand, and that, on the other hand, a currentless period is required between dropout of one contactor and pickup of the other contactor in order to avoid shorting of the line voltage through the frequency changer. There is a certain inherent delayed reaction between release of a switching control signal and dropout of the previously conducting contactor and finally pickup of the other contactor, which depends on the specific components of the specific conveyor device and is allowed for by the mentioned frequency spacing and the mentioned phase spacing.

The method described in German Patent Application 199 60 491.6 has proven itself well. However, there are cases in which one would want to get by with lower control costs and this should be achieved with the present invention.

SUMMARY OF THE INVENTION

The present invention concerns a method for control of the drive of a conveyor device, especially in the form of an escalator or moving sidewalk, switchable between load operation and no-load operation and having a drive motor and a frequency changer controllable at least with respect to the frequency and phase position of its output voltage, in which the drive motor in load operation is fed with a line voltage with an essentially constant line frequency and in no-load operation with the frequency changer output voltage, the phase difference between the phase position of the line voltage and the phase position of the frequency changer output voltage is determined, the phase position of the frequency changer output voltage is corrected according to the determined phase difference and is therefore brought essentially into agreement with the phase position of the line voltage, and switching is initiated as soon as this agreement is reached.

On the other hand, the invention concerns an electrical control device to control the drive of a conveyor device, especially in the form of an escalator or moving sidewalk, switchable between load operation and no-load operation and having a line voltage connection to supply a line voltage with essentially constant line frequency and a drive motor, having a frequency changer controllable at least with respect to frequency and phase position of its output voltage, a controllable switching device with a load operation switching state, in which the drive motor is coupled to the line voltage connection, and a no-load operation switching state, in which the drive motor is coupled to the frequency changer, so that the drive motor in load operation is fed with a line voltage with essentially constant line frequency and in no-load operation with the output voltage of the frequency changer, a phase difference determination device, by means of which the difference between the phase position of the line frequency and the phase position of the output frequency of the frequency changer can be determined before switching from load operation to no-load operation, and a phase control device, by means of which the phase position of the output frequency of the frequency changer can be controlled as a function of the recorded phase difference in essential agreement with the phase position of the line frequency, switching of the switching device being controllable as a function of achievement of such phase agreement.

In one embodiment of the invention, in conjunction with switching from no-load operation to load operation, a ramp-like rise of the output frequency of the frequency changer is initially produced before the output frequency of the frequency changer is brought to the line frequency and switched from frequency changer feed to line voltage feed. Likewise, during switching from load operation to no-load operation, a ramp-like decline in output frequency of the frequency changer can be produced, after switching from line voltage feed to frequency changer feed has occurred. In this manner, a situation is achieved in which the movement speed of the conveyor device both during the transition from no-load operation to load operation and during the transition from load operation to no-load operation changes gently and therefore free of jolts.

In one embodiment of the invention, switching between no-load operation and load operation occurs by means of a switching device that has a first controllable switching device that connects the drive motor to the line voltage connection and a second controllable switching device that connects the drive motor to the frequency changer, in which only one of the two switching devices is connectable conducting and that switching of the nonconducting switching device to the conducting state is only possible after a predetermined currentless period following switching of the switching device that had been conducting to the nonconducting state. This allows for the fact that the contactors ordinarily used for such switching devices do not operate free of delay and ensures that simultaneous conduction of both switching devices does not occur, which could result in a hazardous short circuit of the line voltage through the frequency changer.

During the currentless period the drive motor remains without power supply, which leads to a drop in speed of the drive motor during the currentless period because of slip of the drive motor and inherent friction of the conveyor device, so that a reduction in the magnitude and frequency of the motor terminal voltage occurs.

In order to avoid adverse effects of smooth switching between no-load operation and load operation by these phenomena connected with the currentless periods, in one embodiment of the invention a voltage determination device is provided, by means of which the motor terminal voltage is determined at least during the currentless period. The output voltage of the frequency changer is brought to the determined motor terminal voltage before switching of the drive motor to frequency changer feed. Transient currents during switching between load operation and no-load operation are therefore minimized.

Determination of the motor terminal voltage can occur by means of a voltage measurement device. Since the motor data and the currentless period are normally known for a specific conveyor device, the drop in motor terminal voltage occurring during the currentless period can also be determined from these data. In this case a motor voltage measurement device is not necessary.

Because of the mentioned measures, a situation is achieved in which, during switching from load operation to no-load operation, i.e., during switching from line voltage feed to frequency changer feed at the time at which the motor is connected to the output of the frequency changer, the output voltage of the frequency changer is adapted in terms of voltage and phase to the motor terminal voltage, the motor speed and the motor rotational position of the drive motor.

Since the speed of the drive motor diminishes during the currentless period, one embodiment of the invention proposes that the frequency changer run the drive motor during switching from no-load operation to load operation before the switching process at a speed that lies above the motor speed corresponding to the line frequency by the amount that the motor speed drops during the currentless period. The amount by which the motor speed drops during the currentless period can be determined for the corresponding conveyor device, for example, by measurement, and allowed for during design of the control of the frequency changer.

Ordinary frequency changers have bridge circuits in their output stage containing electronic switches that are controlled with switch control pulses, whose frequency determines the output frequency of the frequency changer. The already discussed control of the voltage value of the frequency changer output voltage is produced in one embodiment of the invention by pulse width modulation of the switch control pulse.

In one embodiment of the invention, a Schmitt trigger circuit is used to determine the phase difference between the phase position of the line voltage and the phase position of the output voltage of the frequency changer, by means of which the time of passage through predetermined threshold values either on the rising flank or falling flank of the line voltage and frequency changer output voltage, for example, the zero passage, is determined. The phase difference can be determined from the time difference of these times.

In one embodiment of the invention, a counter is used to determine the phase difference between the phase position of the line voltage and the phase position of the output voltage of the frequency changer, said counter counts the number of clock pulses of a clock generator occurring between the two mentioned times. The counter is started at the time at which the Schmitt trigger circuit determines achievement of the predetermined threshold value of the line voltage. The counter is stopped at the time at which the Schmitt trigger circuit then determines achievement of the predetermined threshold value of the output voltage of the frequency changer. From the value of the counter reached at this second time, the phase difference between the line voltage and the frequency changer output voltage is derived. The phase position of the frequency changer output voltage is then corrected as a function of this numerical value in order to bring it into agreement with the phase position of the line voltage before a switch is made from line voltage feed to frequency changer feed.

Schmitt triggers can be used to determine both times, i.e., one to determine the phase position of the line voltage, on the one hand, and one to determine the phase position of the frequency changer output voltage, on the other. Since the phase position of the frequency changer output voltage can be deduced from the pulse-like switch control signals for the switch arrangement controlling the output voltage of an ordinary frequency changer, one can also get by with a single Schmitt trigger. In this case, the phase position of the line voltage is determined with the single Schmitt trigger, the counting process of the counter is started with the output signal of the single Schmitt trigger and stopping of the counter is controlled as a function of the switch control signal for the switch arrangement of the frequency changer that determines the phase position of the frequency changer output voltage.

Especially by the last embodiment, a control device according to the invention can be produced with particularly low demands and at particularly low cost accordingly.

In preferred embodiments of the invention, correction of the phase position of the frequency changer output voltage is carried out as a function of the determined phase difference between the line voltage and the frequency changer output voltage only during switching from load operation to no-load operation, whereas during a switch from no-load operation to load operation starting of the frequency changer output voltage is controlled with an empirically determined rising ramp and with slow adaptation of the phase position of the frequency changer output voltage to the phase position of the line voltage.

BRIEF DESCRIPTION OF THE DRAWINGS

The invention is now further explained by means of embodiments. In the drawings.

DETAILED DESCRIPTION OF THE PREFERRED EMBODIMENT

Figure 1:
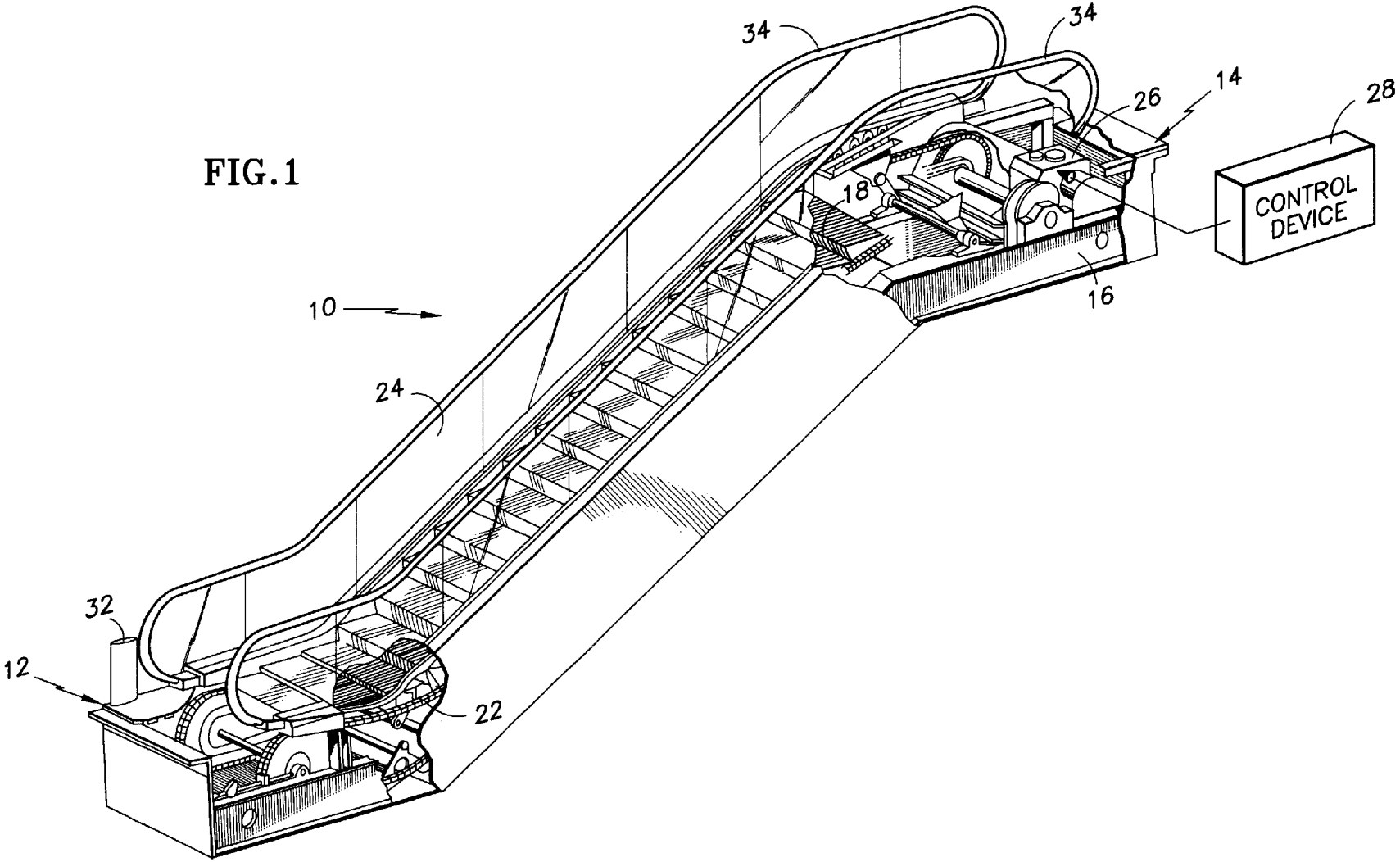
FIG. 1 shows a partial cutaway perspective view of an escalator.

As an example of a conveyor device according to the invention, an escalator is considered, as is apparent in FIG. 1 in a partially cutaway perspective view.

The escalator 10 depicted in FIG. 1 includes lower landing 12, upper landing 14, support framework 16, a number of steps 18 forming an endless belt and arranged in rows one behind the other, drag chain 22 to drive steps 18, a pair of balustrades 24 extending on both sides of steps 18, drive motor 26 drive-coupled to drag chain 22, control device 28 cooperating with drive motor 26, and a transport requirement signal device in the form of passenger sensor 32, which is a light barrier, but can also be formed by a foot mat or a hand or foot switch. Steps 18 form the platforms for transporting the passengers between the two landings 12 and 14. Each of the balustrades 24 has a moving hand rail 34 driven with the same speed as steps 18.

Control device 28 determines the electrical power fed to drive motor 26 and therefore controls the speed of drive motor 26 and the motion speed of steps 18.

Figure 2:
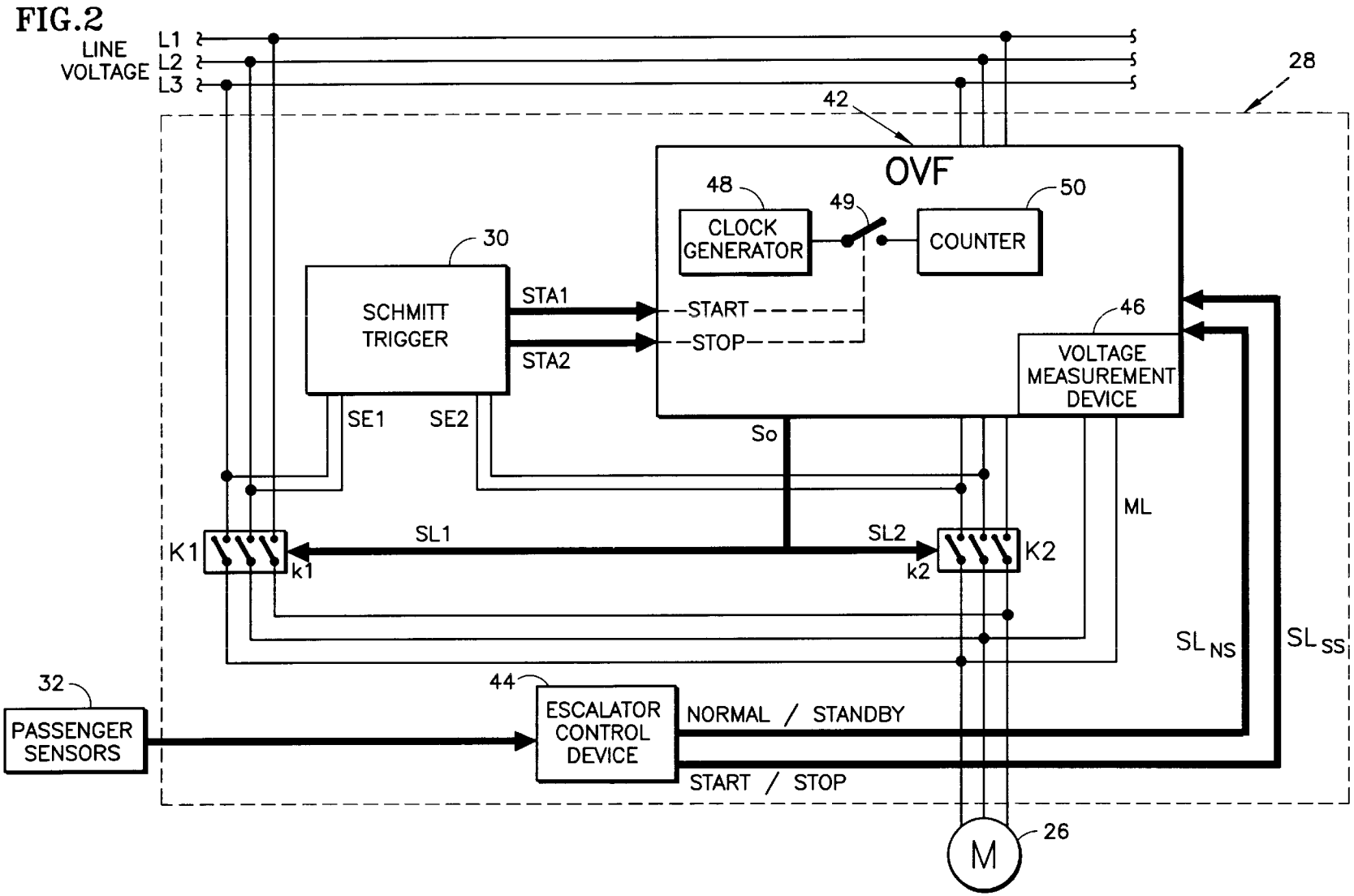
FIG. 2 shows an electrical schematic, partially in a block diagram with a control device according to the invention.

FIG. 2 shows an electrical circuit diagram with an embodiment of control device 28 according to the invention. Control device 28 includes a Schmitt trigger circuit 30 with a first signal input SE1, to which one phase of the three-phase line voltage is fed, and a second signal input SE2, to which one phase of the three-phase frequency changer output voltage is fed.

A program-controlled circuit OVF 42 with variable output frequency (hereafter called OVF 42 for short). In which a clock generator 48, a counter 50 and a frequency changer are integrated, is connected downstream from the Schmitt trigger circuit. An ON/OFF switch 49 is situated between clock generator 48 and counter 50, by means of which a counting input ZE of counter 50 can be connected to the output of clock generator 48 or separated from it.

At the time at which Schmitt trigger circuit 30 has determined the phase position of the line voltage being detected, for example, at zero passage during the rising flank, the Schmitt trigger circuit 30 issues a signal "start" to switch 49 via a control output STA1, through which this switch is controlled into the conducting ON state and counter 50 begins to count the clock pulses of the clock generator. At the time at which Schmitt trigger circuit 30 has determined the phase position of the frequency changer output voltage being detected, the Schmitt trigger circuit 30 issues a signal "stop" to the switch 49 via a control output STA2, through which this switch is controlled into the nonconducting OFF state and counter 50 stops counting the clock pulses from the clock generator. The counting state reached by the counter is then a gauge of the phase difference between the line voltage and the frequency changer output voltage. This counting value is used in order to correct the phase position of the frequency changer output voltage so that it is brought at least essentially into agreement with the phase position of the line voltage. This embodiment requires a Schmitt trigger circuit 30 with two Schmitt triggers.

In an embodiment of the type already mentioned in which the phase position of the frequency changer output voltage is not determined by means of a Schmitt trigger but from the switch control pulses for the switch arrangement of the frequency changer, the stop signal for the switch 49 is delivered directly by the frequency changer and only a single Schmitt trigger is therefore required for the Schmitt trigger circuit 30. This embodiment is particularly economical.

In the embodiment in which both the phase position of the line voltage and the phase position of the frequency changer output voltage are determined with a Schmitt trigger, a filter is preferably connected in front of the signal input SE2 (not shown in FIG. 2), by means of which the output voltage generated by chopping a dc voltage, and therefore a rectangular output voltage of the frequency changer, is converted to a sinusoidal voltage in order to be able to better carry out phase comparison with the sinusoidal line voltage. The phase shift produced by such a filter is compensated in this embodiment by the fact that an equivalent filter is connected in front of signal input SE1.

Control device 28 also contains a controllable switching device with a first contactor K1 and a second contactor K2. OVF 42 is under the controlling effect of an escalator control device 44, whose function depends on passenger sensor 32.

The entire circuit arrangement is designed three-phase and is fed from a three-phase ac system with phase lines L1, L2 and L3. A different number of phases is possible.

Control device 28 is connected on the input side to the three lines L1–L3 of the power system. This means that the input side of contactor K1, on the one hand, and the input side of OVF 42, on the other, are connected to lines L1–L3. The input frequency of the frequency changer contained in OVF 42 is therefore stipulated by the line frequency. Drive motor 26 is connected via contactor K1 to lines L1–L3 of the system and via contactor K2 to the output side of OVF 42.

Escalator control device 44 and OVF 42 are connected to each other via two control lines $SL_{NS}$ and $SL_{SS}$, via which a "normal/standby" signal or a "start/stop" signal are transmitted. OVF 42 obtains control commands that depend on the output signal of the passenger sensor 32 via the two control lines $SL_{NS}$ and $SL_{SS}$.

Control inputs k1 and k2 of K1 and K2 are connected to control output So of OVF 42 via control lines SL1 and SL2, via which they can be placed in the correspondingly required switching state. A field bus can be used instead of discrete control lines SL1, SL2, $SL_{NS}$ and $SL_{SS}$ for transmission of the control signals.

OVF 42 has a voltage measurement device 46 that is connected via a measurement line ML to two of the three connection terminals of the drive motor 26.

Figure 3:
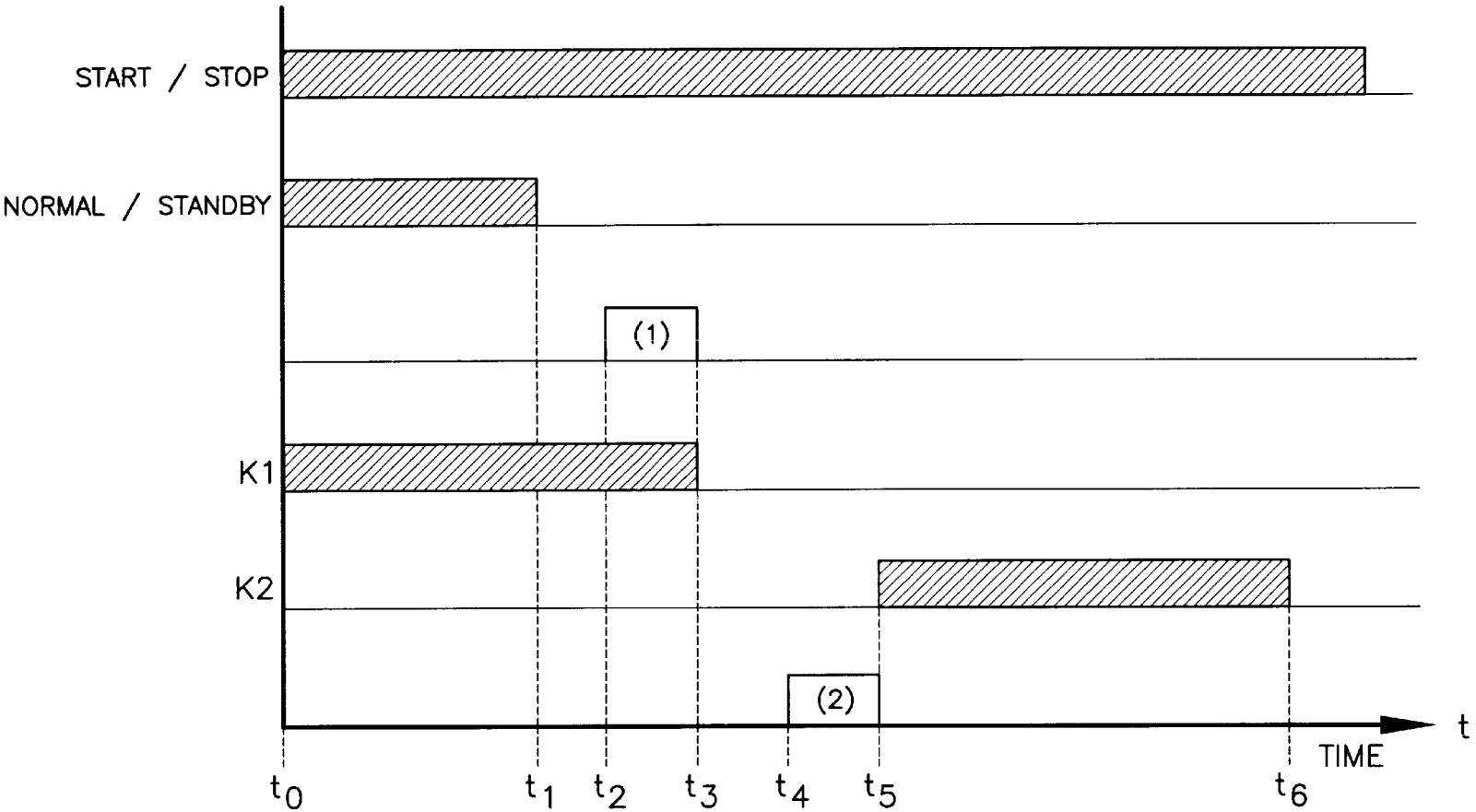
FIG. 3 shows a time diagram of the processes in conjunction with switching of the conveyor device from load operation to no-load operation.

The method of operation of the circuit arrangement shown in FIG. 2 is now explained further with reference to the time diagrams shown in FIG. 3.

FIG. 3 shows a time diagram in conjunction with switching from load operation to no-load operation of escalator 10. The control signals "start/stop" and "normal/standby", the time position of the phase difference measurement, the switching state of contactors K1 and K2 and the time position of measurement of the motor terminal voltage delivered by the escalator control device 44 to OVF 42 are shown from the top down in this figure as a function of time t.

At a time $t_0$, the escalator 10 is in load operation. In this state the control signals "start/stop" and "normal/standby" are both at a logic value H, contactor K1 is switched to be conducting and contactor K2 nonconducting and the drive motor 26 is supplied from the power mains, i.e., with line voltage and line frequency.

Load operation is maintained until a transport requirement no longer exists. The end of the transport requirement is assumed, if the passenger detector 32 has reported no passenger for a predetermined period, i.e., the escalator 10 has not been trodden upon by a new passenger for a predetermined time period.

In the time diagram depicted in FIG. 3, it is assumed that, at time $t_1$, the predetermined period during which no new passenger has been detected has elapsed. At time $t_1$ the control signal "normal/standby" therefore converts from H to L, which initiates switching of the escalator 10 from load operation (passenger transport speed of the escalator 10) to no-load operation (standby speed of the escalator 10) and therefore from line feed to frequency changer feed.

Initially, during a period lasting from $t_2$ to $t_3$, measurement of the phase difference between the line voltage and the frequency changer output voltage is carried out by means of Schmitt trigger circuit 30. For this purpose, the Schmitt trigger circuit 30 is either brought by means of a control signal (not shown in the figures) into a measurement state or the Schmitt trigger circuit 30 is permanently found in the measurement state and the switchability of switch 49 into the conducting ON state is only released at time $t_2$ by OVF 42, for example, by corresponding programming of OVF 42.

At time $t_3$, the phase position of the frequency changer output voltage is adjusted to the phase position of the line voltage so that the phase difference becomes zero and switching of contactor K1 into the nonconducting switching state occurs so that line voltage feed of drive motor 26 is ended.

After a lag time lasting from time $t_3$ to time $t_5$, the contactor K2 is switched into the conducting state. Switching of escalator 10 from load operation to no-load operation and therefore switching of the drive motor 26 from line voltage feed to frequency changer feed are therefore ended.

During the currentless period extending from $t_3$ to $t_5$, the motor terminal voltage drops. In the preferred embodiment of the invention depicted in FIG. 2, during the period $t_4$ to $t_5$ falling within the currentless interval, the motor terminal voltage is determined by means of the voltage determination device 46, either by measurement or derivation of the data of the drive motor 26 and the conveyor device 10 and the voltage value of the frequency changer output voltage is adjusted to the determined motor terminal voltage by corresponding adjustment of the pulse pattern of the switch control signals by means of which the switching arrangement of the frequency changer is controlled.

When the contactor K2 enters the conducting state at time $t_5$ and the drive motor 26 is therefore connected to the output of OVF 42, the output voltage of OVF 42 is brought into agreement in terms of phase with the line voltage and in terms of voltage with the motor terminal voltage so that, at time $t_5$, smooth switching of the drive motor 26 to frequency changer feed can occur.

It can be determined from the motor data and the conveyor device data or by empirical measurement by which value the phase position of the motor terminal voltage drops during the currentless period relative to the line phase position to which the phase position of the frequency changer output voltage has been brought at time $t_3$. When the phase position of the frequency changer output voltage is corrected during the currentless period by a corresponding phase value, a particularly smooth transition of motor feed from line voltage feed to frequency changer feed is achieved.

A smooth switching from no-load operation to load operation can be achieved by the fact that at least the frequency and the phase position, preferably also the amplitude, of the output voltage of the frequency changer are controlled so that they lie above the frequency, phase position and amplitude of the line voltage by the amount by which the motor speed and amplitude of the motor terminal voltage drop during the currentless period. The amount by which the motor speed and amplitude of the motor terminal voltage drop during the currentless period can be determined for the corresponding conveyor device and can be considered in laying out the frequency changer. The output voltage of the frequency changer is then controlled with respect to frequency, phase position and voltage to the values that lie above those of the line voltage accordingly.

What is claimed is:

1. Method for controlling the drive of a conveyor device (10), especially in the form of an escalator or moving sidewalk, switching between load operation and no-load operation, having a drive motor (26) and a frequency changer (42) controllable at least with respect to frequency and phase position of its output voltage, in which: the drive motor (26) in load operation is fed with a line voltage with essentially constant line frequency and in no-load operation with the frequency changer output voltage; the phase difference between the phase position of the line voltage and the phase position of the frequency changer output voltage is determined; the phase position of the frequency changer output voltage is corrected according to the determined phase difference and therefore brought essentially into agreement with the phase position of the line voltage; switching is produced as soon as this agreement is reached; and wherein to determine the phase difference the time occurrence of comparable events on the voltage trend of the line voltage and frequency changer output voltage are recorded and the phase difference between the phase positions of the line frequency and the frequency changer output voltage is derived from the time difference of occurrence of these events.

2. Method according to claim 1, in which a Schmitt trigger circuit (30) is used, by means of which the times of passage through predetermined threshold values in a predetermined direction of change of the line frequency, on the one hand, and the frequency changer output voltage, on the other, are recorded and the phase difference between the line frequency and frequency changer output voltage is determined from them.

3. Method according to claim 1, in which a frequency changer (42) is used whose output voltage is determined by a switch arrangement controlled with pulse-like switch control signals; a Schmitt trigger circuit 30 is used, by means of which the time at which the line voltage passes through a predetermined threshold value in a predetermined direction of change is recorded; the time at which the frequency changer output voltage passes through a corresponding threshold value in the corresponding direction of change is derived from the switch control signals; and the phase difference between the line voltage and frequency changer output voltage is determined from the two times.

4. Method according to claim 3, in which, in conjunction with switching from load operation to no-load operation, a ramp-like drop in the output frequency of the frequency changer (42) is controlled after switching from line voltage feed to frequency changer feed.

5. Method according to claim 3, in which, in conjunction with switching from no-load operation to load operation, a ramp-like rise in output frequency of the frequency changer (42) is initially controlled to the line frequency and then the phase position of the frequency changer output voltage is gradually adapted to the phase position of the line voltage with an empirically determined ramp.

6. Method according to claim 3, in which the drive motor (26) during switching between line voltage feed and frequency changer feed is operated without feed for a currentless period.

7. Method according to claim 3, in which the output voltage of frequency changer (42) is changed relative to the line voltage.

8. Method according to claim 6, in which the motor terminal voltage is determined during the currentless period.

9. Method according to claim 8, in which the change in motor terminal voltage is measured during the currentless period.

10. Method according to claim 8, in which the change in motor terminal voltage is derived from the motor data during the currentless period.

11. Method according to claim 8, in which the output voltage of the frequency changer (42) is brought to the motor terminal voltage during the currentless period.

12. Electrical control device to control the drive of a conveyor device (10), especially in the form of an escalator or a moving sidewalk, switchable between load operation and no-load operation, having a line voltage connection to supply a line voltage with essentially constant line frequency and a drive motor (26), having: a frequency changer (42) controllable at least with respect to the frequency and phase position of its output voltage; a controllable switching device (K1, K2) with a load operation switching state in which the drive motor (26) is connected to the line voltage connection and a no-load operation switching state in which the drive motor (26) is connected to the frequency changer (42), so that the drive motor (26) in load operation is fed with a line voltage with essentially constant line frequency and in no-load operation with the output voltage of the frequency changer (42); a phase difference determination device (30), comprising a Schmitt trigger device by means of which, before switching from load operation to no-load operation, the difference between the phase position of the line voltage and the phase position of the output voltage of the frequency changer (42) can be determined; and a phase control device (48, 50), by means of which the phase position of the output voltage of the frequency changer (42) can be controlled as a function of the determined phase difference essentially in agreement with the phase position of the line voltage; in which switching of the switching device (K1, K2) is controllable as a function of achievement of such phase agreement.

13. Control device according to claim 12, having: the frequency changer (42), whose output voltage is determined by a switch arrangement controlled by pulse-like control signals.

14. Control device according to claim 13, in which the processing device (38, 50) has: a clock generator (48) that generates clock pulses and a counter (50), by means of which the number of clock pulses that were generated by the clock generator (48) between the two times can be counted.

15. Control device according to claim 14, in which phase position of frequency changer output voltage can be controlled as a function of the counting state reached by counter (50) at the second time.

16. Control device according to claim 5, in which: the switching device (K1, K2) has a first controllable switching device (K1) that connects the drive motor (26) to the line voltage connection and a second controllable switching device (K2) that connects the drive motor to the frequency changer (42); only one of the two switching devices (K1, K2) can be connected conducting; and connection of the nonconducting switching device (K1, K2) to the conducting state is only possible after a predetermined currentless period after the switching device (K1, K2) that had been conducting to this point is made nonconducting.

17. Control device according to claim 16, in which the output voltage of the frequency changer (42) is controllable relative to the line voltage.

18. Control device according to claim 17, having: a voltage determination device (46), by means of which the motor terminal voltage can be determined at least during the currentless period, and a voltage control device, by means of which the output voltage of the frequency changer (42) can be controlled during the currentless period to the determined voltage value of the motor terminal voltage.

19. Control device according to claim 18, in which the switching arrangement of the frequency changer (42) controlled with pulse-like switch control signals can be controlled with pulse-width-modulated switch control signals to control the output voltage of the frequency changer (42).

* * * * *